US005970956A

United States Patent [19]

Sturman

[11] Patent Number: 5,970,956

[45] Date of Patent: Oct. 26, 1999

[54] CONTROL MODULE FOR CONTROLLING HYDRAULICALLY ACTUATED INTAKE/ EXHAUST VALVES AND A FUEL INJECTOR

[76] Inventor: Oded E. Sturman, One Innovation Way, Woodland Park, Colo. 80863

[21] Appl. No.: 08/799,296

[22] Filed: Feb. 13, 1997

[51] Int. Cl.[6] ..... F02M 37/04; F01L 9/02

[52] U.S. Cl. ..... 123/508; 123/90.12

[58] Field of Search ..... 123/446, 508, 123/509, 90.12, 41.31, 458

[56] References Cited

U.S. PATENT DOCUMENTS

| | | | |
|---|---|---|---|
| 4,919,102 | 4/1990 | Iwabuchi | 123/41.31 |
| 5,170,755 | 12/1992 | Kano | 123/90.12 |
| 5,209,453 | 5/1993 | Aota | 123/90.12 |
| 5,224,683 | 7/1993 | Richeson | 123/90.12 |
| 5,237,968 | 8/1993 | Miller | 123/508 |
| 5,237,976 | 8/1993 | Lawrence | 123/90.12 |
| 5,248,123 | 9/1993 | Richeson | 123/90.12 |
| 5,339,777 | 8/1994 | Cannon | 123/90.12 |

*Primary Examiner*—Carl S. Miller

*Attorney, Agent, or Firm*—Blakely Sokoloff Taylor & Zafman

[57] ABSTRACT

A control module which controls camless hydraulically driven intake and exhaust valves and an hydraulically driven fuel injector of an internal combustion engine. The module contains a valve assembly to control the intake valve, a valve assembly to control the exhaust valve and a valve assembly to control the fuel injector. The valve assemblies preferably each contain a pair of solenoid actuated two-way spool valves. The solenoids are actuated by digital pulses provided by an electronic assembly within the module. The solenoid actuated spool valves control the flow of a hydraulic fluid to and from the fuel injector and the intake and exhaust valves. The hydraulic fluid opens and closes the intake and exhaust valves. The hydraulic fluid also actuates the fuel injector to eject a fuel into a combustion chamber of the engine. The electronic assembly of each module can be connected to a main microprocessor which provides commands to each assembly. Each electronic assembly processes the command, feedback signals from the hydraulically actuated devices and historical data to insure a desired operation of the fuel injector and intake and exhaust valves.

23 Claims, 8 Drawing Sheets

CONTROL MODULE FOR CONTROLLING HYDRAULICALLY ACTUATED INTAKE/ EXHAUST VALVES AND A FUEL INJECTOR

BACKGROUND OF THE INVENTION

1. Field of the Invention

The present invention relates to a control module for controlling the actuation of hydraulically driven fuel injectors and intake/exhaust valves for an internal combustion engine.

2. Description of Related Art

Compression ignition internal combustion engines contain a plurality of reciprocating pistons located within combustion chambers of an engine block. Associated with each piston is a fuel injector that sprays a highly pressurized fuel into the combustion chamber. The fuel is mixed with air that is introduced into the chamber through an intake valve. After combustion the exhaust flows out of the chamber through an exhaust valve. The injection of fuel and movement of the intake and exhaust valves are typically controlled by mechanical cams. Cams are relatively inefficient and susceptible to wear. Additionally, the cams do not allow the engine to vary the timing of fuel injection, or the opening and closing of the intake/exhaust valves.

U.S. Pat. No. 5,255,641 issued to Schechter and assigned to Ford Motor Co. and U.S. Pat. No. 5,339,777 issued to Cannon and assigned to Caterpillar Inc. disclose hydraulically driven intake/exhaust valves that do not require cams to open and close the valves. The movement of the intake/exhaust valves is controlled by a solenoid actuated fluid valve(s). When the fluid valve(s) is in one position an hydraulic fluid flows into an enclosed stem portion of the intake/exhaust valve. The hydraulic fluid exerts a force on the stem which opens the valve. When the fluid valve(s) is switched to another position the intake/exhaust valve moves back to the original closed position. The fluid valve(s) is switched by an electronic controller. The controller can vary the timing of the intake/exhaust valves to optimize the performance of the engine.

U.S. Pat. No. 5,460,329 issued to Sturman discloses an hydraulically driven fuel injector. The Sturman injector contains a solenoid actuated fluid valve that is connected to an electronic controller. The valve and controller control the timing and amount of fuel injected into the combustion chamber of the engine. To date the camless intake/exhaust valves disclosed in Schechter and Cannon, and the hydraulically driven fuel injector disclosed in Sturman have always been provided as separate units which must be individually assembled to the engine block. Each unit has separate electrical wires that must be connected to the engine controller. Connecting a number of wires and separate actuating components increases the assembly cost of the engine. Additionally, because of manufacturing tolerances there may be variations in the lengths of the wires. A variation in the wire length may change the timing and amplitude of the driving signals transmitted to the solenoid actuated control valves. A change in the driving signals may degrade the performance of the engine. It would be desirable to provide a single electronic hydraulic module that controls camless hydraulically driven intake/exhaust valves and a fuel injector of a combustion chamber. It would also be desirable if the single module had a minimum number of external wires.

The solenoid actuated fluid valves for the intake/exhaust valves are typically connected to a single microprocessor which can vary the valve timing in response to variations in a number of input parameters such as fuel intake, hydraulic rail pressure, ambient temperature, etc. The microprocessor can vary the start time and the duration of the driving signal provided to the fluid valves to obtain a desired result. Because of variations in manufacturing tolerances, different valves may have different responses to the same driving pulse. For example, given the same driving pulse one intake valve may open for a shorter period of time than another intake valve in the same engine.

The Schechter patent discusses a process wherein each valve is calibrated to determine a correction value. The correction value is stored within the electronics of the engine and used to either shorten or lengthen the driving pulse provided to each valve so that the valves are all open for the same time duration. Although effective in compensating for variations in manufacturing tolerances, the Schechter technique does not compensate for variations that occur during the life of the engine. For example, one of the valves may stick and require more energy to move into an open position. It would be desirable to provide a module which can individually analyze the intake/exhaust valves and fuel injector to insure that the corresponding combustion chamber is operating at an optimum performance during the life of the engine.

The hydraulic fluid for hydraulically driven fuel injectors is typically provided by a pump and a series of fluid lines. The fluid system typically contains a spring biased pressure relief valve which opens to insure that the fluid pressure does not exceed a certain level. The pump performs work to overcome the spring of the relief valve during the by-pass mode of the system. It would be desirable to provide an hydraulic system for a camless engine, wherein the fluid pressure can be controlled without any additional components, or without requiring additional work by the pump to reduce the pressure within the system.

Some internal combustion engines contain a "turbocharge" assembly which varies the air flow into the combustion chambers. Some turbochargers contain complicated electronic devices to vary and control the air flow into the chamber. The electronic devices add to the cost and complexity of the engine. It would be desirable to provide a single control module that can control a fuel injector, an intake valve, an exhaust valve and a turbocharge unit.

SUMMARY OF THE INVENTION

The present invention is a control module which controls camless hydraulically driven intake and exhaust valves and an hydraulically driven fuel injector of an internal combustion engine. The module contains a valve assembly to control the intake valve, a valve assembly to control the exhaust valve and a valve assembly to control the fuel injector. The valve assemblies preferably each contain a pair of solenoid actuated two-way spool valves. The solenoids are actuated by digital pulses provided by an electronic assembly within the module. The solenoid actuated spool valves control flow of a hydraulic fluid to and from the fuel injector and the intake and exhaust valves. The hydraulic fluid opens and closes the intake and exhaust valves. The hydraulic fluid also actuates the fuel injector to eject a fuel into a combustion chamber of the engine. The electronic assembly of each module can be connected to a main microprocessor which provides commands to each assembly. Each electronic assembly processes the commands, feedback signals from the hydraulically actuated devices and historical data to insure a desired operation of the fuel injector and intake and exhaust valves. The module is a relatively light and compact component that can be mounted onto the combustion chamber of the engine. Each module typically requires no more than three wires which minimizes the complication and cost of assembly. One of the modules can be actuated to provide a by-pass for the hydraulic system of the engine. Additionally, the timing of the exhaust valves can be varied to control a turbocharger.

DETAILED DESCRIPTION OF THE INVENTION

Figure 1:
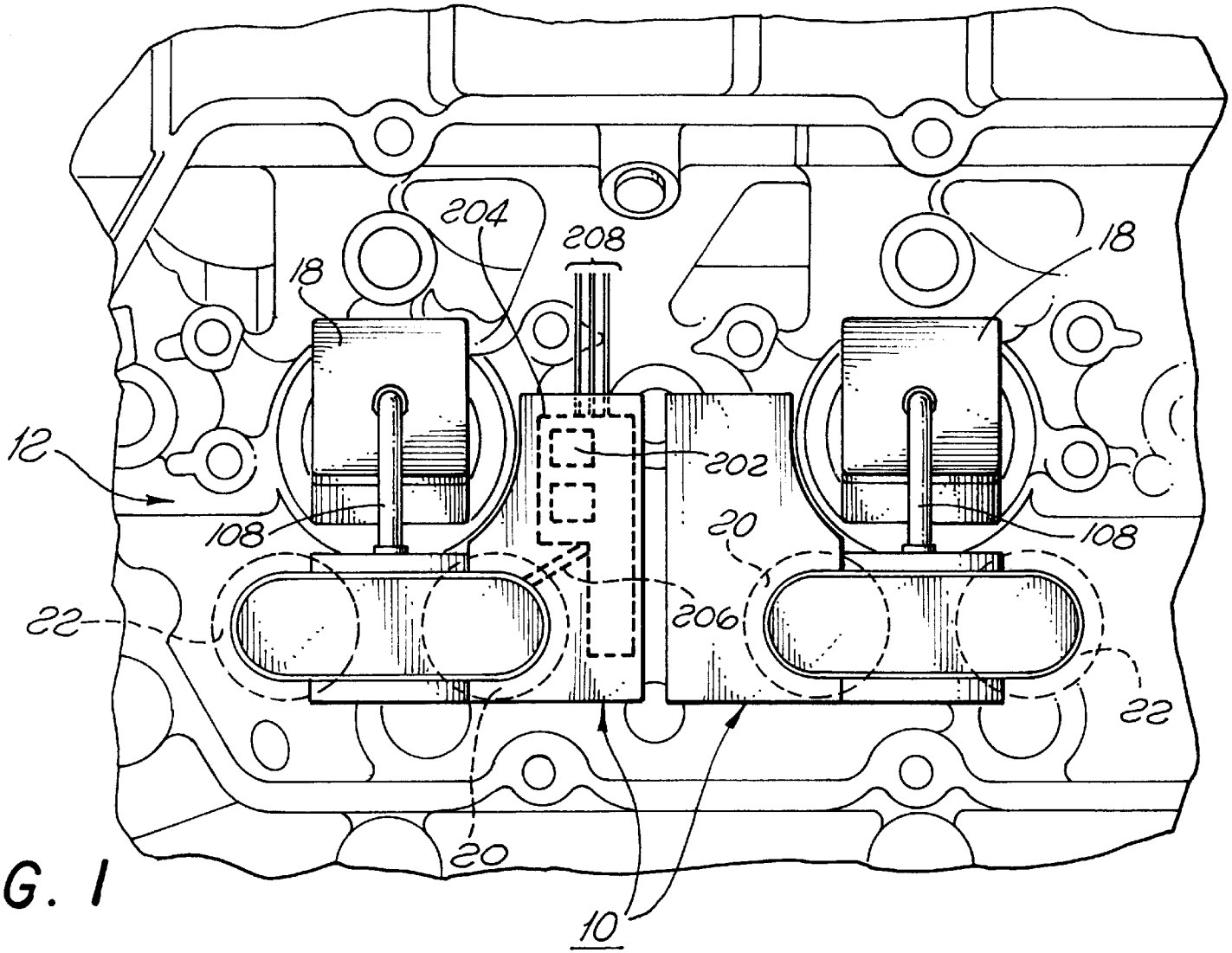
FIG. 1 is a top perspective view showing a control module mounted to an internal combustion engine.
Figure 2:
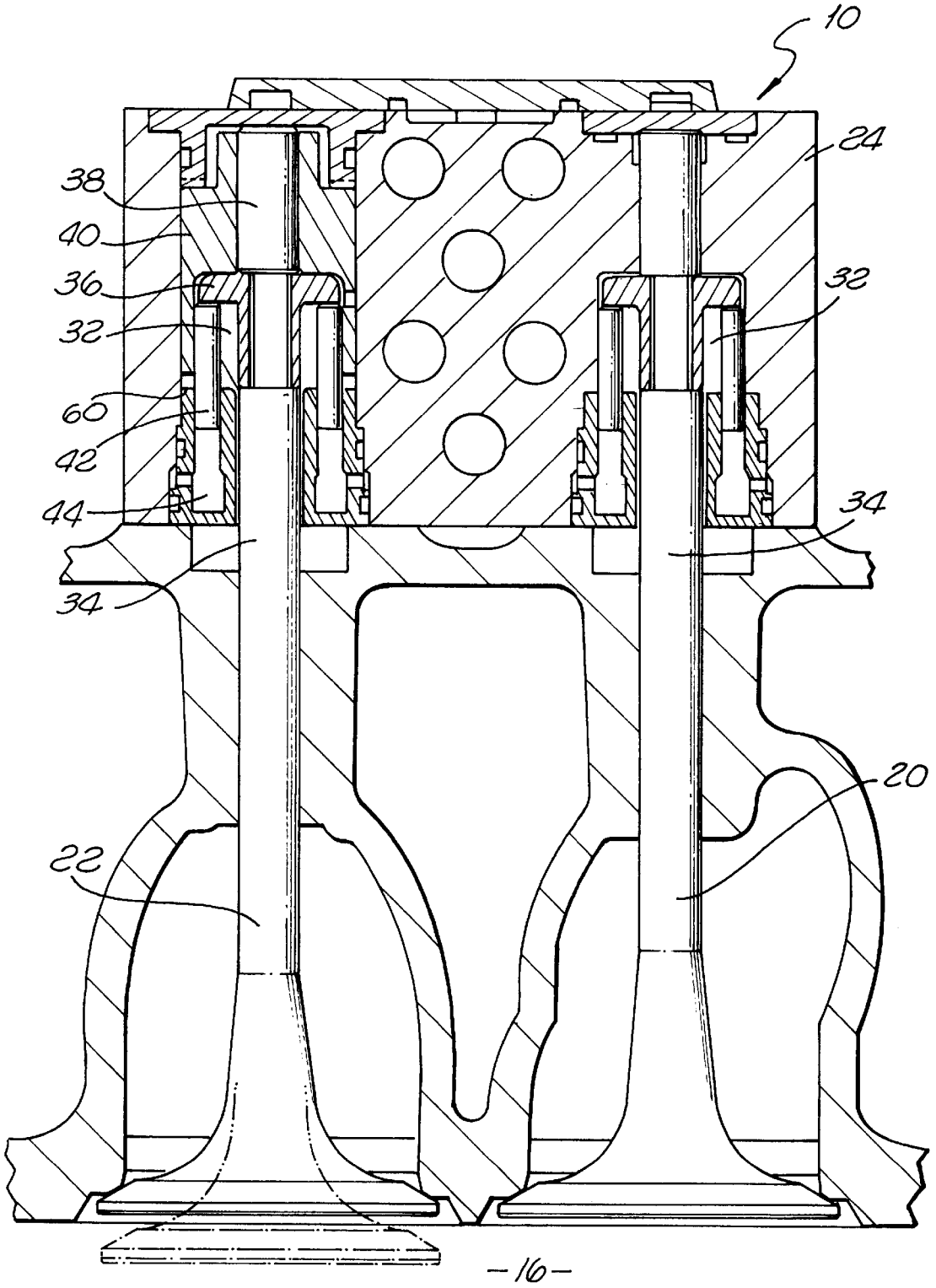
FIG. 2 is a cross-sectional view of the control module.
Figure 3:
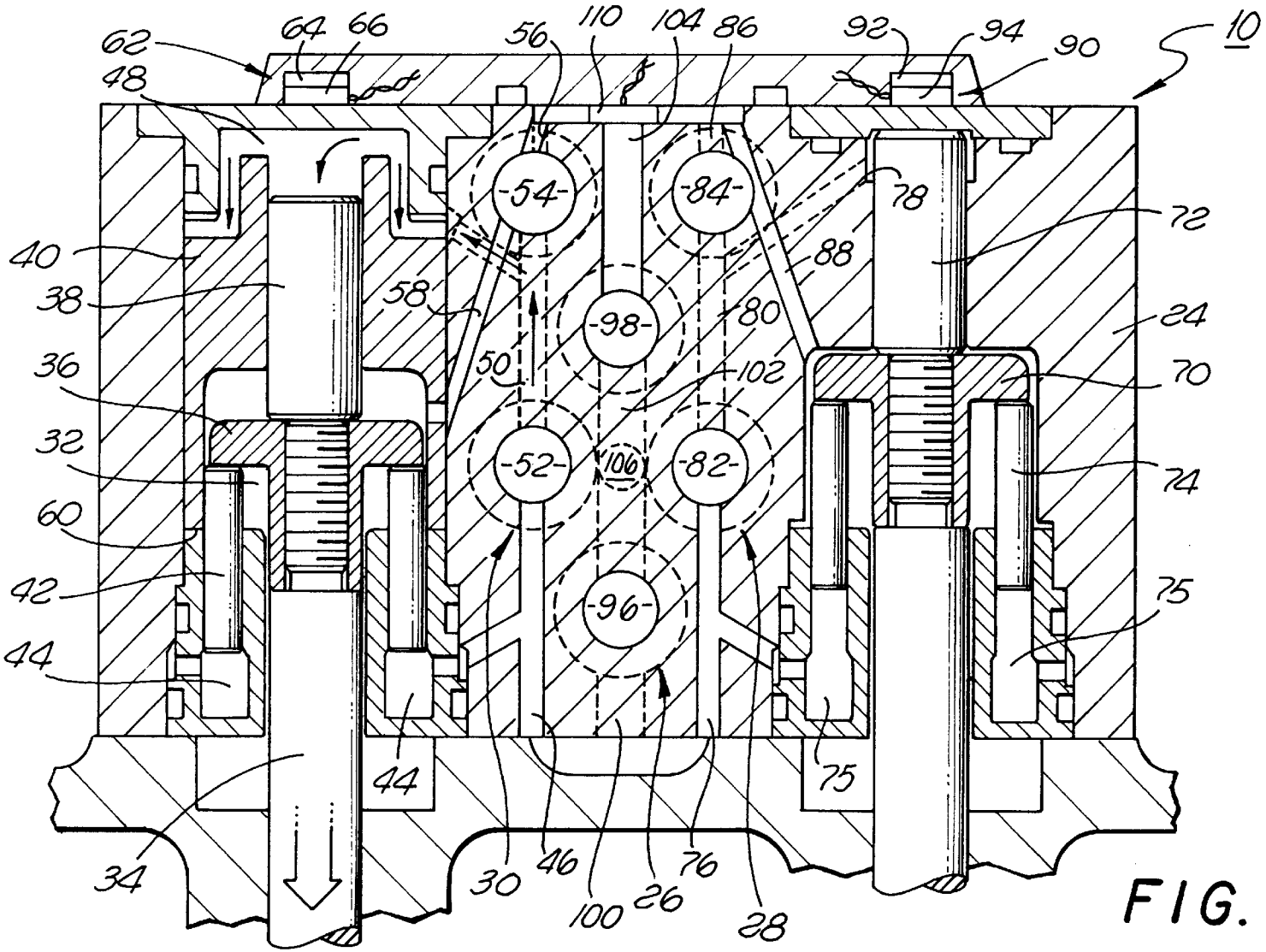
FIG. 3 is a cross-sectional view of the control module showing an exhaust-valve moving to an open position.

Referring to the drawings more particularly by reference numbers, FIGS. 1–3 show a control module 10 of the present invention. The module 10 is typically mounted to a head 12 of an engine block 14. The block 14 has a plurality of combustion chambers 16 which each contain a reciprocating piston (not shown). Coupled to each combustion chamber 16 is a fuel injector 18, an intake air valve 20 and an exhaust valve 22. The fuel injector 18, intake valve 20 and exhaust valve 22 are each hydraulically driven devices that do not require cams. The module 10 controls the operation of the fuel injector 18, the intake valve 20 and the exhaust valve 22 by directing hydraulic fluid to and from the devices 18, 20 and 22.

As shown in FIGS. 2 and 3, the module 10 includes a housing 24. Within the housing 24 is a fuel injector valve assembly 26, an intake valve assembly 28 and an exhaust valve assembly 30. The housing 24 also has a pair of cavities 32 that contain the stem 34 of the intake valve 20 and the stem 34 of the exhaust valve 22. The intake valve assembly 28 controls the flow of a hydraulic fluid to move the valve stem 34 in a reciprocating motion between an open position and a closed position. Likewise, the exhaust valve assembly 30 controls the hydraulic fluid to move the valve stem 34 of the exhaust valve between open and closed positions.

The exhaust valve stem 34 is attached to a head 36 that engages a pin 38 and a power pin 40. The pins 38 and 40 move the exhaust valve 22 from a closed position to an open position. The head 36 is biased into a closed position by a pair of return pins 42 located within a pair of corresponding channels 44 of the housing 24. The channels 44 are connected to a pressurized fluid line 46 within the housing 24. The fluid line 46 and channels 44 contain a pressurized hydraulic fluid which applies a pressure to the return pins 42 that pushes the head 36 and valve 22 into an upward closed position.

The pin 38 and power pin 40 are located within an hydraulic chamber 48 that is connected to a common line 50. In the preferred embodiment, the exhaust valve assembly 30 includes two solenoid actuated two-way spool valves 52 and 54. Valve 52 is connected to the pressurized fluid line 46 and the common line 50. Valve 54 is connected to the common line 50 and a drain line 56. The housing 24 may also have a vent line 58 which allows fluid that leaks past the pins 38 and 40 to vent to the drain line 56.

As shown in FIG. 3, when valve 52 is open and valve 54 is closed, pressurized hydraulic fluid flows into the chamber 48 to push the pins 38 and 40. The pins 38 and 40 have a larger area than the return pins 42 so that the hydraulic fluid pushes the exhaust valve 22 to the open position. The power pin 40 moves until the pin 40 engages a step 60 in the housing 24. The pin 38 continues to move the exhaust valve 22 even after progress of the power pin 40 is impeded by the step 60. The power pin 40 provides an additional force to initially open the exhaust valve 22. It being understood that the exhaust within the combustion chamber is relatively high when the exhaust valve 22 is closed. The power pin 40 provides enough force to overcome the high exhaust pressure. When the exhaust valve 22 is open there is a rapid reduction in the exhaust pressure. Only the smaller pin 38 is required to move the exhaust valve 22 against the lower pressure exhaust within the combustion chamber.

When valve 52 is closed and valve 54 is open the chamber 48 is connected to the drain line 56. The return pins 42 push the head 36 and move the exhaust valve 22 back to the closed position. The module 10 may include a exhaust valve position sensor assembly 62 that includes a magnet 64 and a Hall effect sensor 66. The Hall effect sensor 66 provides an output voltage that decreases as the pin 38 and exhaust valve 22 move away from the magnet 64.

The intake valve stem 32 also has a head 70 that is coupled to a pin 72 and a pair of return pins 74. The return pins 74 are located within channels 75 connected to a pressurized fluid line 76. The pin 72 is located within an hydraulic chamber 78 that is connected to a common line 80. In the preferred embodiment, the intake valve assembly 28 includes a pair of solenoid actuated two-way spool valves 82 and 84. Valve 82 is connected to the pressurized fluid line 76 and the common line 80. Valve 84 is connected to the common line 80 and a drain line 86. The housing 24 may also have vent line 88.

When valve 82 is open and valve 84 is closed the hydraulic fluid pushes the pin 72 and moves the intake valve 20 from the closed position to the open position. When valve 82 is closed and valve 84 is open the return pins 74 push the head 70 and move the intake valve 20 back to the closed position. The module 10 may also have an intake valve position sensor assembly 90 that includes a magnet 92 and a Hall effect sensor 94.

In the preferred embodiment, the fuel injector valve assembly 18 includes a pair of solenoid actuated two-way spool valves 96 and 98. Valve 96 is connected to a pressurized fluid line 100 and a common line 102. Valve 98 is connected to the common line 102 and a drain line 104. The common line 102 is connected to a cylinder port 106 of the housing 24. As shown in FIG. 1, the cylinder port 106 may be connected to a corresponding port of the fuel injector by a fluid line 108. The drain line 104 may contain a pressure sensor 110 that is used to monitor the operation of the fuel injector 18.

When valve 96 is open and valve 98 is closed, pressurized hydraulic fluid is provided to the fuel injector 18. When valve 98 is open and valve 96 is closed hydraulic fluid is allowed to flow from the fuel injector 18 and into the drain line 104.

Figure 4:
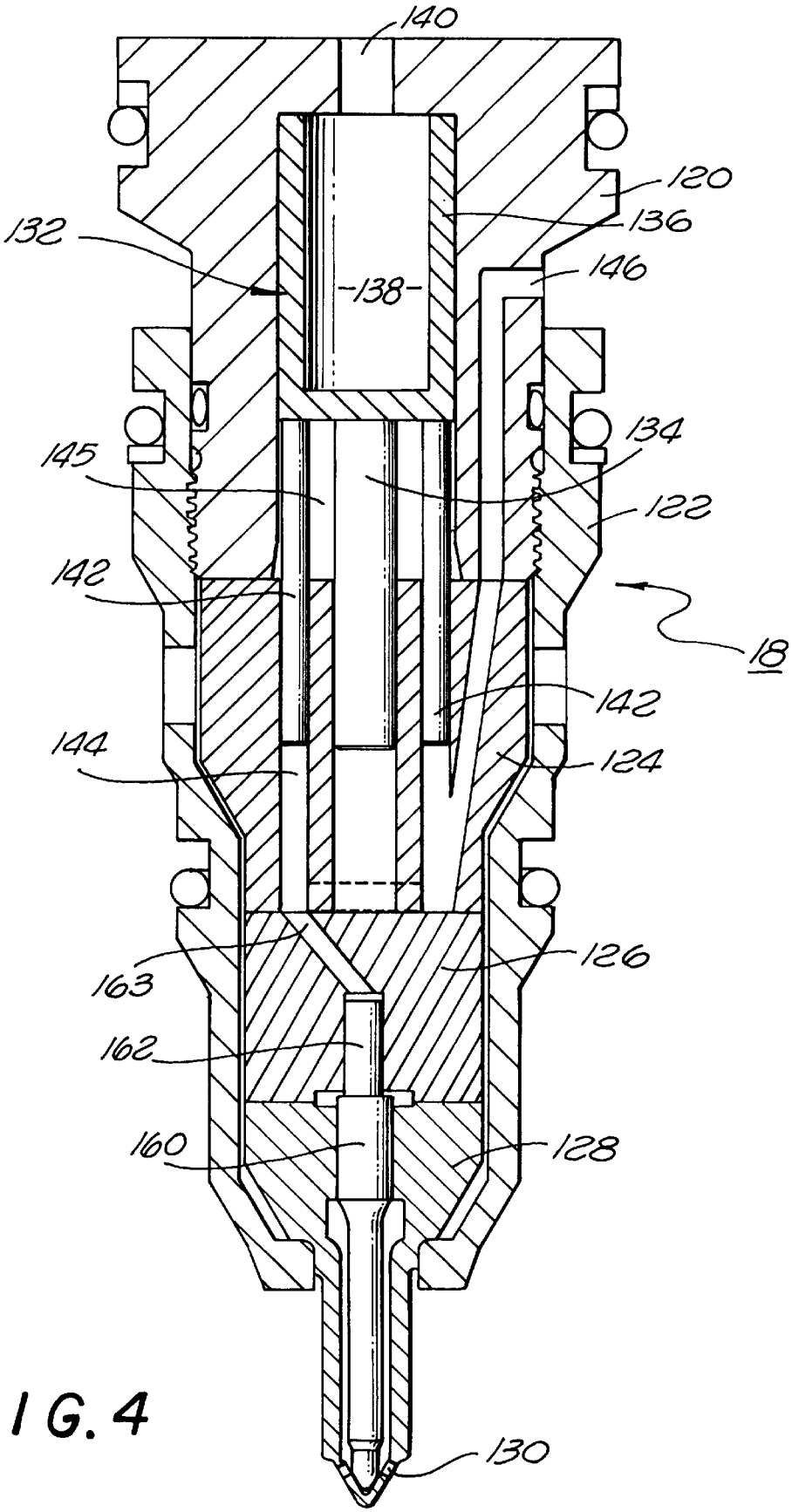
FIG. 4 is a cross-sectional view of a fuel injector.
Figure 5:
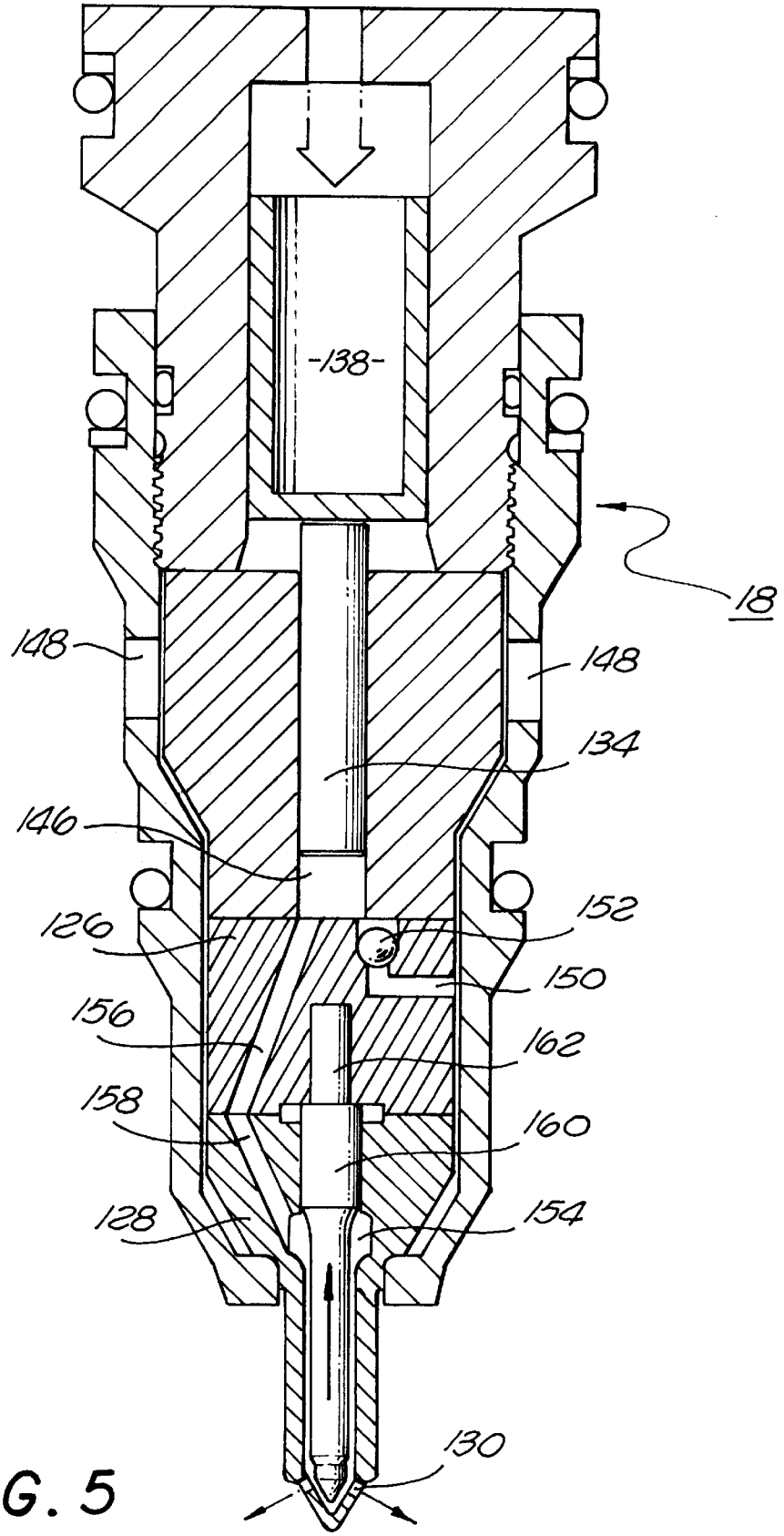
FIG. 5 is a cross-sectional view of a fuel injector.

FIGS. 4 and 5 show a preferred embodiment of a fuel injector 18. The fuel injector 18 includes a top block 120 that is attached to an outer shell 122. The outer shell 122 contains an intensifier block 124, a passage block 126 and a needle housing 128. The needle housing 128 has a plurality of apertures 130 that allow fuel to be ejected from the fuel injector 18.

The fuel injector 18 includes an intensifier 132 which has a piston 134 and a head 136. The head 136 has a cavity 138 that is in fluid communication with a cylinder passage 140. The cylinder passage 140 is connected to the fluid line 108 and cylinder port 106 of the module housing 24. The intensifier 132 is coupled to a pair of return pins 142 located within a pair of corresponding channels 144 in block 124. The channels 144 are connected to a supply port 146 that is coupled to the pressurized hydraulic fluid. The area of the intensifier head 136 is larger than the return pins 142 so that the intensifier 132 moves in a downward direction when pressurized fluid is provided at cylinder passage 140. The return pins 142 move the intensifier 132 back to the original position when the cylinder passage 140 is connected to drain. The cavity portion 145 beneath the intensifier head 136 is typically coupled to a drain line to prevent build up of hydrostatic pressure which may counteract the downward movement of the intensifier 132.

The intensifier piston 134 moves within a fuel chamber 146 in block 124. The fuel chamber 146 is coupled to a pair of fuel ports 148 by a passage 150 and a one-way check valve 152. The fuel chamber 146 is also connected to a needle chamber 154 by passages 156 and 158 in blocks 126 and 128, respectively. The needle chamber 154 contains a needle valve 160. The needle valve 160 is biased into a closed position by a pin 162 that is in fluid communication with a passage 163 that is connected to the channels 144 and pressurized hydraulic fluid.

Figure 6:
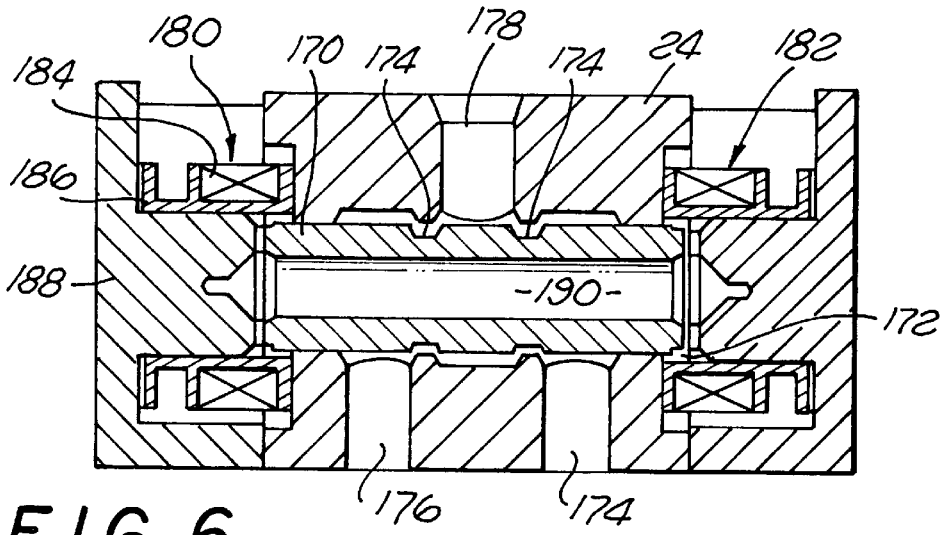
FIG. 6 is cross-sectional view of a fluid control valve.

When the module 10 is actuated so that valve 96 is open and valve 98 is closed, pressurized fluid flows from the cylinder port 106 of the module 10 and into the cavity 138 of the intensifier head 136. As shown in FIG. 6, the hydraulic fluid moves the intensifier 132 and pushes fuel that is within the fuel chamber 146 into the needle chamber 154. The check valve 152 prevents the fuel from flowing back through the fuel ports 148. The pressure of the fuel lifts the needle valve 160 into an open position so that fuel is ejected through the apertures 130.

When valve 96 is closed and valve 98 is open, the cylinder passage 140 is coupled to the drain line 104 of the module 10. The return pins 142 push the intensifier 132 in an upward direction. The movement of the intensifier piston 134 draws more fuel into the fuel chamber 146. The pin 162 pushes the needle valve 160 back to the closed position wherein the process can be repeated.

FIG. 6 shows a preferred embodiment of a solenoid actuated two-way spool valve used in the module 10. The valve includes a spool 170 located within a spool chamber 172. The spool 170 has a pair of annular grooves 174 that allow fluid communication between a pair of inlet ports 176 and an outlet port 178. By way of example, for valve 96 the inlet ports 176 may be the pressurized fluid line 100 and the outlet port 178 may be the common line 102. The dual inlet ports 176 provides a valve wherein the fluid forces exerted on the spool 170 are in opposite directions. The opposing fluid forces offset each other, thereby providing a dynamically balanced valve.

Each valve has a first solenoid 180 and a second solenoid 182. Each solenoid 180 and 182 includes a coil 184 wound around a bobbin 186. The solenoids 180 and 182 are secured by end caps 188 inserted into the housing 24. When energized the first solenoid 180 moves the spool 170 to a first position wherein fluid is allowed to flow from the inlet ports 176 to the outlet port 178. When the second solenoid 182 is energized the spool 170 moves to a second position so that the spool 170 prevents fluid from flowing through the valve. The spool 170 preferably contains an inner channel 190 that prevents fluid from being trapped between the ends of the spool 170 and the end caps 188.

In the preferred embodiment the spool 170 and end caps 188 are constructed from a magnetic steel such as 52100. The module housing 24 may also be constructed from a magnetic steel material. The magnetic steel retains enough magnetism to provide a magnetic force which holds the spool 170 in position even when power to the solenoids is terminated. The valve can therefore be switched with a short digital pulse that is provided to one of the solenoids 180 and 182.

Referring to FIG. 1, the module 10 preferably contains an electronic assembly 200 that provides the digital driving pulses that switch the fluid control valves and actuate the fuel injector 18, and intake 20 and exhaust 22 valves. The electronic assembly 200 includes a number of integrated circuits 202 mounted to a printed circuit board 204. The printed circuit board 204 is connected to the solenoids of the fluid control valves by internal wires 206 within the module 10. The circuit board 204 is also connected to three wires 208 that extend from the module 10. Two of the wires typically provide electrical power to the integrated circuits 202 while the remaining wire provides a conduit for digital logic signals to and from the electronic assembly 200.

As an alternate embodiment, the wires which carry digital signals may be filter optic cables coupled to corresponding photometers and photodetectors. The fiber optic system can operate at relatively high rates and are not susceptible to electrical noise such as electromagnetic interference from the engine.

The present invention provides a relatively small low cost module that can be readily mounted to the head of an engine. The module 10 requires a minimal number of external wires that need to be connected to the remaining electronics of the engine. Each module 10 can also be connected to diagnostic equipment so that individual combustion chambers can be tested and analyzed.

Figure 7:
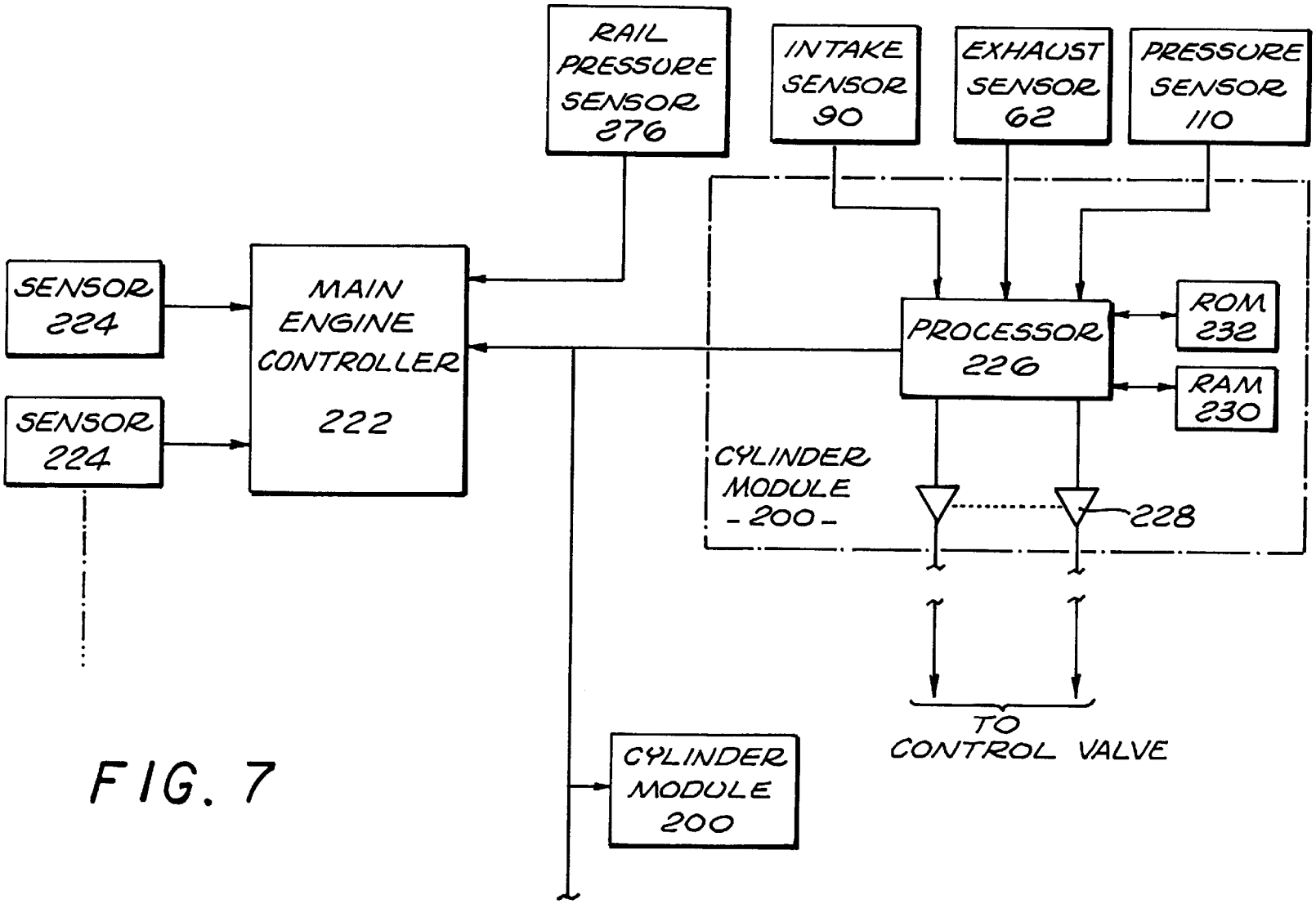
FIG. 7 is a schematic of an electrical system of the present invention.

FIG. 7 shows an electronic system 220. The system 220 includes a main engine controller 222 that is connected to the electronic assemblies 200 of the engine cylinder modules for each combustion chamber. Although only one engine cylinder module 200 is shown, it is to be understood that the main controller 222 is connected to a plurality of cylinder modules 200.

The main controller 222 is typically a microprocessor that is connected to a plurality of engine sensors 224 such as air temperature, engine speed, etc. The main controller 222 provides a series of commands to the cylinder module 200. Each cylinder module 200 contains a microprocessor 226 which receives the commands from the main processor 222, process the commands and provides outputs to actuate the fuel injector 18, and intake 20 and exhaust 22 valves.

The cylinder module 200 typically contains electronic driver circuits 228 that drive the solenoids of the fluid control valves. The cylinder module 200 may also have both volatile (RAM) 230 and non-volatile (ROM) memory 232 devices that store data that can be processed by the processor 226. The ROM device 230 can store software routines that are used by the processor 226 to actuate the injector 18 and valves 20 and 22. The microprocessor 226 also receives feedback signals from the intake valve position sensor 90, the exhaust valve position sensor 62 and the pressure sensor 110.

The processors 226 for each module can process the input commands, feedback signals and stored data to provide a desired actuation of the injector 18 and the valves 20 and 22. Each injector and intake/exhaust valve may respond differently for a given digital pulse generated by a cylinder module. Additionally, the ROM device 232 may contain corrective factors for each device 18, 20 or 22. The corrective factors may be determined in a calibration routine of the module 10, injector 18 and valves 20 and 22. The correction factors can be used to vary the timing and duration of the digital driving pulses provided to the spool valves.

Additionally, each module 10 can compensate for variations in individual components by sensing the movement of the devices and then adjusting the digital pulse during the next cycle. For example, the cylinder module 200 may provide a digital pulse to the valves 82 and 84 to open the intake valve 20. The intake position sensor 90 provides feedback on the actual movement of the valve 20. If the valve 20 did not move at the desired times or for a desired stroke the cylinder module 200 may store the feedback and utilize the data to adjust the digital pulse for the next cycle. Likewise, the processor 226 may determine the amount of fuel from the pressure of the hydraulic fluid flowing from the cylinder passage 140 of an injector 18 as sensed by the pressure sensor 110. The processor 226 can use this data to correct the digital driving pulse for the next cycle. The cylinder module continuously updates the driving signal for each cycle or after a predetermined number of cycles. The present invention thus provides a local processing capability that can update, process and compensate for variations in the injector 18 and valves 20 and 22 during the life of the engine.

The modules 10 can also be used to control other functions of a car engine. For example, it is sometimes desirable to utilize the combustion chambers to slow down the speed of the engine in a process commonly referred to as Jake breaking. In a Jake break routine air is introduced to the combustion chamber but not fuel. The intake and exhaust are actuated so that the engine performs work to compress the air within the chamber. The work generated to compress the air reduces the engine speed. The main controller 222 may generate command signals to enter a Jake brake routine, wherein the processors 226 of the modules actuate the valves 20 and 22 so that the engine pistons compress air. The processors 222 and 226 can provide commands and digital pulses to vary the timing of the valves 20 and 22 to obtain a desired breaking result depending upon engine speed, etc.

Figure 8:
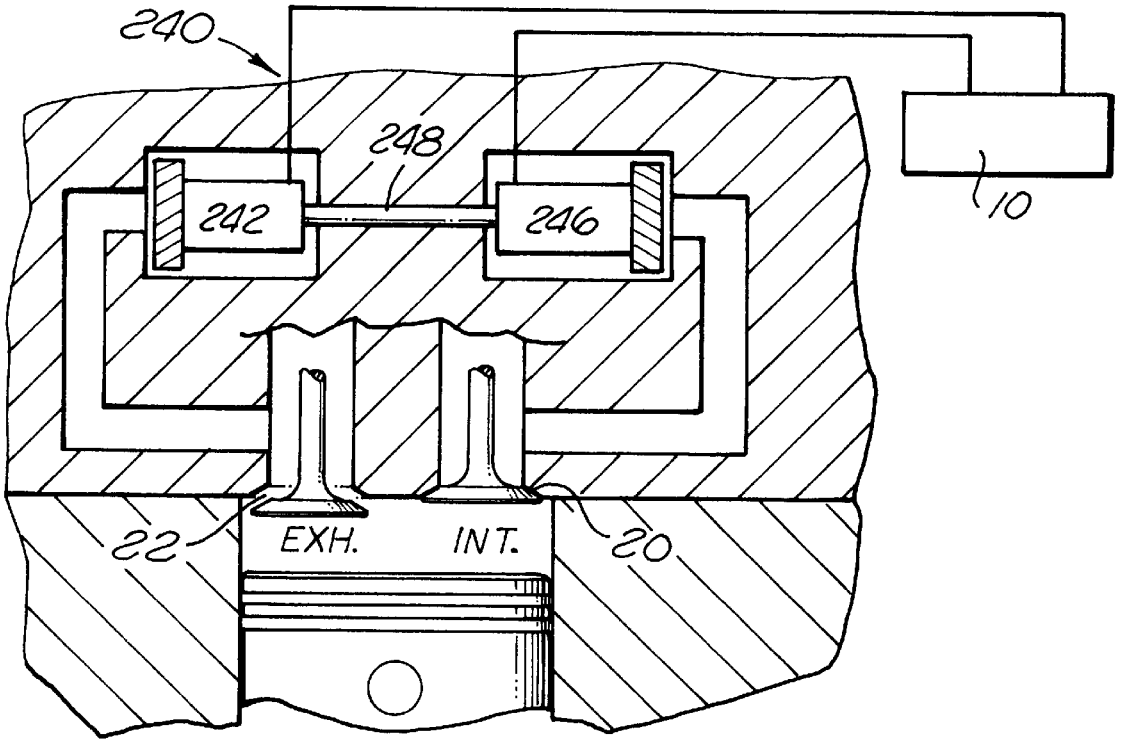
FIG. 8 is a schematic showing a turbocharger.

FIG. 8 shows another utility of the modules. The engine may have a turbocharger assembly 240 that controls the air flow into the combustion chamber. The assembly 240 may include an exhaust turbine 242 located within the exhaust manifold 244 of the engine and an intake turbine 246 located within the intake manifold 248 of the engine. The intake turbine 246 is connected to the exhaust turbine 242 by a shaft 248 so that turbine 246 rotates with turbine 242.

The module 10 can control the opening of the exhaust valve 22 to control the flow of exhaust across the exhaust turbine 242 and the timing and speed at which the intake turbine 246 rotates. Varying the speed of the intake turbine 246 changes the air flow into the combustion chambers. The module 10 can therefore control the flow of air into the combustion chamber by varying the movement of the exhaust valve 22. It being understood that the module 10 may also control the opening of the intake valve 20 to further control the flow of air.

Figure 9:
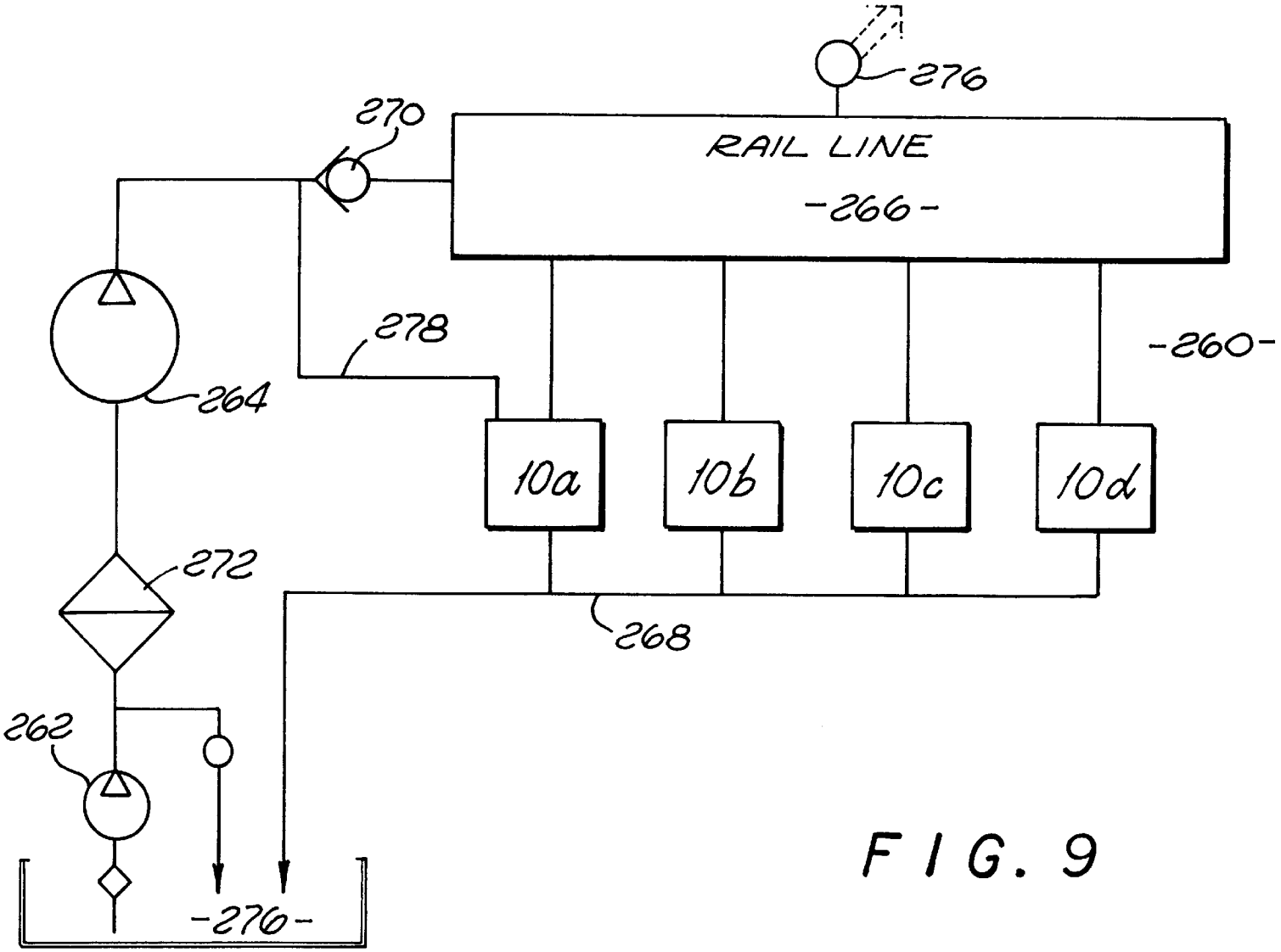
FIG. 9 is a schematic of a hydraulic system for a plurality of modules.

FIG. 9 shows an hydraulic fluid system 260 for actuating the injectors 18 and valves 20 and 22. The system 260 includes a low pressure pump 262 and a high pressure pump 264. The output of the high pressure pump 264 is connected to a rail fluid line 266. The rail line 266 is connected to the pressurized fluid lines 46, 76 and 100 of the modules 10*a–d*. The system 260 also has a drain line 268 that is connected to the drain lines 56, 86 and 104 of the modules 10*a*–10*d*. The system may further have a one-way check valve 270 in the rail line 266, a filter 272 between the pumps and a reservoir 274 of hydraulic fluid. The rail pressure can be sensed by a pressure sensor 276 that is connected to the microprocessor 222.

One of the modules 10*a–d* is connected to a by-pass line 278 of the rail. The by-pass line 278 and module 10a can be used to control the rail pressure within the system. By way of example, the by-pass line 278 may be connected to the pressurized fluid line 76 of the intake valve assembly 28 of module 10*a*, although it is to be understood that the by-pass line 278 may be connected to the exhaust valve assembly 30, or the fuel injector valve assembly 26.

When the intake valve 22 is not being actuated, the valves 82 and 84 of the intake assembly 28 may be opened to allow the fluid within the rail line 266 to flow to the drain line 268 to reduce the rail pressure. Consequently, the intake valve assembly 28 may have a first mode wherein valve 82 is open and valve 84 is closed to allow fluid to open the intake valve 20, a second mode wherein valve 82 is closed and valve 84 is open to close the valve 20, and a third mode wherein valves 82 and 84 are open to provide a by-pass function. The by-pass function is provided without any additional components. Additionally, the pump does not have to work to maintain the valves in the open position as required with spring biased relief valves of the prior art. The microprocessor 222 can sense the rail pressure through the sensor 276 and open the valves to control the rail pressure of the system, accordingly.

Referring to FIGS. 2, 3 and 8, in operation, the microprocessor 222 may receive an input signal to increase the engine speed. The processor 222 provides an output command to the cylinder modules. The processors 226 of the modules 10 process the command and provide output driving signals to actuate the intake valve assemblies 28 and open the intake valves 20. After a calculated time period the processors 226 of the modules provide output signals to close the intake valves 20.

In accordance with a software routine and the input command the module processors 226 provide output signals to actuate the fuel injector 18 at desired times and for desired time intervals. The output signals may be unique for each module to compensate for variations in components. The module processors 226 eventually provide output signals to open and close the exhaust valves 22. The sensors provide feedback data which can be stored and used in the next cycle(s).

While certain exemplary embodiments have been described and shown in the accompanying drawings, it is to be understood that such embodiments are merely illustrative of and not restrictive on the broad invention, and that this invention not be limited to the specific constructions and arrangements shown and described, since various other modifications may occur to those ordinarily skilled in the art.

What is claimed is:

1. A fluid control system for an internal combustion engine which contains a first hydraulically controlled device and a second hydraulically controlled device, comprising:

a pump that pumps a fluid from an outlet port;

a pressurized rail line coupled to said outlet port of said pump;

a drain line;

a first valve assembly that is connected to said pressurized rail line, said drain line, and the first hydraulically controlled device, said first valve assembly can be switched into either a first, second, or third mode, wherein the first hydraulically controlled device is coupled to said pressurized rail line when said first valve assembly is in the first mode, and coupled to said drain line when said first valve assembly is in the second mode, said pressurized rail line is coupled to said drain line when said first valve assembly is in the third mode; and, a second valve assembly that is connected to said pressurized rail line, said drain line, and the second hydraulically controlled device, said second valve assembly can be switched into either a first or second mode, wherein the second hydraulically controlled device is coupled to said pressurized rail line when said second valve assembly is in the first mode, and coupled to said drain line when said second valve assembly is in the second mode.

2. The system as recited in claim 1, wherein said first valve assembly and said second valve assembly each contain a pair of two-way spool valves.

3. The system as recited in claim 2, wherein each two-way control valve includes a pair of solenoids that move a spool.

4. The system as recited in claim 3, further comprising a first electronic assembly which provides power to said solenoids of said first valve assembly and a second electronic assembly which provides power to said solenoids of said second valve assembly.

5. The system as recited in claim 4, wherein said spools of said two-way valves are latched into a position by a digital pulse provided by said electronic assemblies.

6. The system of claim 1, wherein said first valve assembly includes a housing which has a fuel injector valve bore and a fuel injector valve assembly that has a valve which is located within said fuel injector valve bore.

7. The system of claim 6, wherein said fuel injector valve assembly includes a pair of solenoids that move a spool.

8. The system of claim 7, further comprising an electronic assembly that is located within said housing and which provides power to said solenoids.

9. The system of claim 8, wherein said electronic assembly provides a plurality of digital pulses to said solenoids.

10. The system of claim 9, wherein said spool is latched into one of two positions.

11. The system of claim 6, wherein said fuel injector valve assembly includes a pair of two-way spool valves.

12. The system of claim 1, wherein said first valve assembly includes a housing which has an intake bore and an intake valve assembly that has a valve which is located within said intake valve bore.

13. The system of claim 12, wherein said intake valve assembly includes a pair of solenoids that move a spool.

14. The system of claim 13, further comprising an electronic assembly that is located within said housing and which provides power to said solenoids.

15. The system of claim 14, wherein said electronic assembly provides a plurality of digital pulses to said solenoids.

16. The system of claim 15, wherein said spool is latched into one of two positions.

17. The system of claim 12, wherein said intake valve assembly includes a pair of two-way spool valves.

18. The system of claim 1, wherein said firs valve assembly includes a housing which has an exhaust bore and an exhaust valve assembly that has a valve which is located within said exhaust valve bore.

19. The system of claim 18, wherein said exhaust valve assembly includes a pair of solenoids that move a spool.

20. The system of claim 17, further comprising an electronic assembly that is located within said housing and which provides power to said solenoids.

21. The system of claim 20, wherein said electronic assembly provides a plurality of digital pulses to said solenoids.

22. The system of claim 21, wherein said spool is latched into one of two positions.

23. The system of claim 18, wherein said exhaust valve assembly includes a pair of two-way spool valves.

* * * * *